United States Patent [19]

Akrenius

[11] Patent Number: 4,913,017

[45] Date of Patent: Apr. 3, 1990

[54] MEAT CUTTING DEVICE

[75] Inventor: Jari Akrenius, Helsinki, Finland

[73] Assignee: Fendo Ky, Klaukkala, Finland

[21] Appl. No.: 177,471

[22] Filed: Apr. 1, 1988

[30] Foreign Application Priority Data

Apr. 13, 1987 [FI] Finland ..... 871605

[51] Int. Cl.[4] ..... B02C 18/06; B26D 1/15; B26D 1/20

[52] U.S. Cl. ..... 83/121; 83/122; 83/145; 83/425.3

[58] Field of Search ..... 83/145, 425.3, 121, 83/122; 17/52; 99/485, 357

[56] References Cited

U.S. PATENT DOCUMENTS

| | | | |
|---|---|---|---|
| 135,370 | 1/1873 | Saugi | 83/121 |
| 402,171 | 4/1889 | Lewis | 83/121 |
| 739,817 | 9/1903 | Berchtold | 83/121 |
| 1,898,338 | 2/1933 | Bulaich | 83/425.3 X |
| 2,138,262 | 11/1938 | Urschel et al. | 83/425.3 X |
| 2,584,262 | 2/1952 | DeLamater, Sr. . | |
| 2,912,027 | 11/1959 | Townsend . | |
| 3,685,561 | 8/1972 | Beasley . | |
| 3,893,384 | 7/1975 | Lobiondo et al. . | |
| 4,254,533 | 3/1981 | Lobiondo et al. . | |

FOREIGN PATENT DOCUMENTS

| | | |
|---|---|---|
| 1518702 | 7/1978 | United Kingdom . |

*Primary Examiner*—Donald R. Schran
*Attorney, Agent, or Firm*—Nixon & Vanderhye

[57] ABSTRACT

A meat cutting device comprising a feeding chute defining for the meat a path inclined towards a blade assembly, the blade assembly being formed by a plurality of disc-like cutting blades; whereby the meat piece to be cut passes automatically through the cutting blades due to the combined effect of the inclined path and the cutting blades.

13 Claims, 1 Drawing Sheet

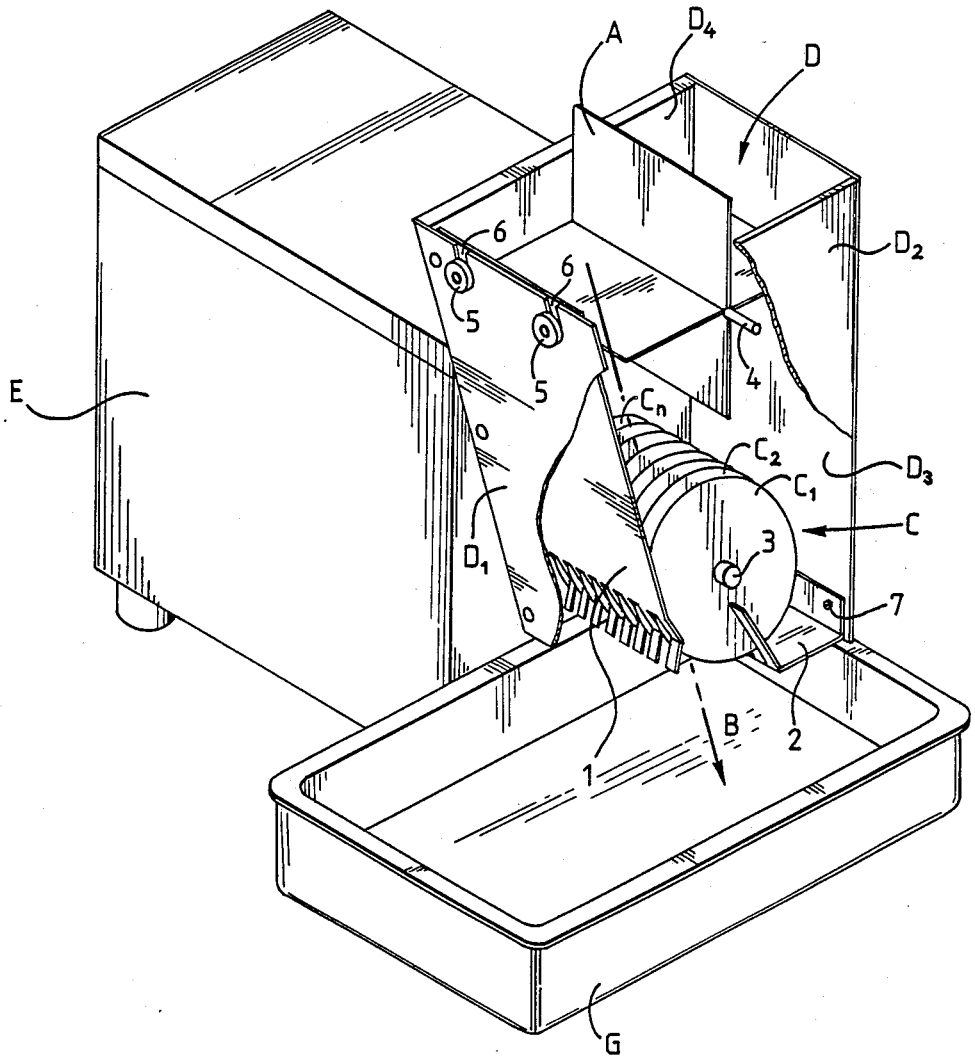
A
$D_4$
D
$D_2$
6
6
5
5
4
E
$C_n$
$C_2$
$C_1$
$D_3$
C
3
$D_1$
7
B
2
1
G

MEAT CUTTING DEVICE

The invention relates to a device for cutting meat in particular. More specifically, it is concerned with a device for cutting meat by machine.

Meat is generally cut manually e.g. in households, shops, meat wholesale firms, etc. Self-evidently, this takes plenty of time and effort. Moreover, the size of the slices, strips or cubes so obtained varies, which easily leads to unsatisfactory results in cooking. Further, accidents at work are likely to occur particularly in connection with cutting on a larger scale.

Therefore, attempts have been made to develop devices by means of which the cutting can be carried out by machine.

A device in which a piece of meat is pressed by hand through rotating blades is intended mainly for domestic use. To avoid injuries, some kind of pushing means is used. The capacity of this kind of device is, of course, rather low, about 20 to 30 kg/h at the most. For industrial use, a device is developed in which meat is pressed by means of a pushing piston through cutting blades. In this case, too, the capacity is rather low and the result obtained by the press effect is not too satisfactory.

The object of the present invention is to provide a device by means of which the above drawbacks are avoided and the best possible cutting result and capacity are obtained. This object is achieved by means of a device which comprises a feeding chute defining for the meat a path which is inclined towards a rotatably mounted blade assembly having a plurality of disc-like cutting blades.

The basic idea of the device according to the invention is that a piece of meat, such as a joint, is drawn automatically towards the cutting blades and therethrough during the cutting operation, whereby the cutting is carried out rapidly and evenly, no pushing means damaging the meat and the blades are needed, and accidents, such as injuries to hands or fingers, are avoided. Due to the simple structure of the device, it is easy to take to pieces and, accordingly, easy to maintain and clean, which is of importance especially for hygienic reasons. The "automatic" operation of the device also promotes safety at work, which is discussed more closely below.

The invention will be described in more detail in the following with reference to the figure of the attached drawing, which shows a schematic view of the device.

In the meat cutting device of the figure, a feeding chute D comprises four walls $D_{1-4}$. The cross-sectional area of the feeding chute is rectangular and tapers downwards so that a front wall $D_1$ only is inclined towards a blade assembly C. A shaft 4 of a feeding lid A is mounted rotatably in bearings at the top of the feeding chute. The feeding lid comprises four plates positioned perpendicularly to each other and extending substantially to the four walls of the feeding chute. A shaft 3 of the blade assembly C is mounted rotatably in bearings in the lower portion of the feeding chute and it is connected to a squirrel cage motor E acting as a power source e.g. by means of V-belts. The walls of the feeding chute extend below the blade assembly. The shafts 3 and 4 are positioned substantially in the same vertical plane. Comb blades 1 and 2 are arranged within the feeding chute at the opposite front wall $D_1$ and rear wall $D_3$. The comb blade 1 is fastened to the front wall $D_1$ by means of screws 5 at guide recesses 6 formed in the upper edge of the side wall. The comb blade 2 is fastened correspondingly to the rear wall $D_3$ by means of screws 7 at guide recesses (not shown) in the lower edge of the side wall. The planar teeth of the comb blade 1 form a ridge towards the blade assembly C, whereby they extend partly between cutting blades $C_{1-n}$. The teeth of the comb blade 2 are bent upwards at the lower edge of the feeding chute towards the shaft 3 of the blade assembly C, whereby they are positioned substantially in parallel with the front wall $D_1$ and the comb blade 1 fastened thereto and extend substantially tangentially to the shaft 3 of the blade assembly C on the side of the front wall $D_1$ so that they reach between the cutting blades $C_{1-n}$. The function of the guide recesses 6 is to make the installation of the comb blades 1 (and 2) easier so that the teeth of the comb blades do not touch the cutting blades $C_{1-n}$ at the installation stage and damage these.

A side wall $D_2$ of the feeding chute D is detachable. Accordingly, both the feeding lid A and the blade assembly C are easily detachable for cleaning and other maintaining procedures. The individual cutting blades $C_{1-n}$ of the blade assembly C are likewise detachable and their mutual spacing can be adjusted by means of spacers according to the desired thickness of slices. The comb blades 1 and 2 are also easily detachable for cleaning.

In the following the operation of the meat cutting device will be described in more detail, in which connection the function of the structural details appears more clearly.

A piece of meat, such as a joint, is placed on a plane of the feeding lid A adjacent to the inclined front wall $D_1$. The feeding lid is rotated anticlockwise so that the meat is displaced within the feeding chute D. The meat is passed on along a path B inclining towards the blade assembly C and indicated with an arrow. When the meat touches the cutting blades $C_{1-n}$ of the blade assembly rotating in the direction of motion of the meat, these in cooperation with the inclined inner wall automatically draw the meat through the blade assembly C, whereafter the meat is removed from the feeding chute in the form of slices into a meat collecting receptacle G called a "gastronomy receptacle". Thus the sliced meat can be transferred to be cut again, which results in strips. A third cutting gives cubes as a result. The teeth of the comb blade 1 forming ridges between the cutting blades $C_{1-n}$ ensure that the meat is sliced throughout. The teeth of the comb plate 2 both guide the meat out of the feeding chute and prevent the displacement of the meat piece with the blade assembly to the other side of the feeding chute.

The "automatic drawing through" described above results from the combined effect of the inclined path B and the blade angle of the cutting blades $C_{1-n}$. In a preferred embodiment the angle of inclination of the path with respect to the vertical plane defined by the shafts 3 and 4 is about 15°, the tilt of the ridge of the teeth of the comb blade 1 with respect to this vertical plane about 30°, and the angle of point of the symmetrically ground cutting blades $C_{1-n}$ about 12°.

Furthermore, this automatic operation enables the realization of safety promoting structures. The feeding lid A acts both as meat feeding means and as a safety means. In connection with the proper feeding process as well as otherwise the feeding lid protects hands and fingers so they will not get into contact with the blade assembly C. In addition, a safety switch is provided at a point where the shaft 4 of the feeding lid is mounted in bearings so as to prevent the starting of the device when the feeding lid is not in place. Below the feeding chute there can also be provided a protective cover which is returnable by spring force and which is pushed aside when the meat collecting receptacle is positioned under the feeding chute D and which returns automatically when the receptacle is removed, thus closing the opening below the feeding chute.

In view of the maintenance and durability, it is advisable to make the structures of the present meat cutting device of a stainless material. Besides meat, other materials such as liver, sausage, vegetables, etc., can also be cut by means of the device.

The drawing and the description related thereto are only intended to illustrate the idea of the invention. In its details the device according to the invention may vary within the scope of the claims.

I claim:

1. A meat cutting device comprising:

a body part;

a cutting means carried by said body part arranged for cutting meat;

said body part including a feeding chute defining an inclined path for carrying the meat towards said cutting means;

said feeding chute having a front wall, a rear wall and two side walls;

said cutting means including a rotatably mounted blade assembly formed by a plurality of spaced disc-shaped cutting knives having circular cutting edges for receiving the meat from the chute;

whereby the meat is drawn automatically towards the cutting knives and through the spaces between the knives in order to produce cleanly through-cut slices or the like of the meat.

2. A meat cutting device according to claim 1 wherein said inclined path for the meat is defined by the front wall of said feeding chute and disposed to incline downwards towards said blade assembly.

3. A meat cutting device according to claim 2 including a first comb blade carried by said front wall and having teeth extending downwards and partly between said cutting knives.

4. A meat cutting device according to claim 3 wherein the teeth of the first comb blade are planar and the width thereof corresponds substantially to the spacing between the cutting knives.

5. A meat cutting device according to claim 3 including a second comb blade carried by said rear wall opposite said front wall and having teeth extending upwards and partly between the cutting knives.

6. A meat cutting device according to claim 5 wherein the teeth of said second comb blade are planar and the width thereof corresponds substantially to the spacing between the cutting knives.

7. A meat cutting device according to claim 6 including a shaft carried by said body part for mounting said knives, the teeth of the second comb blade projecting upwards toward said shaft of said blade assembly substantially parallel to said front wall.

8. A meat cutting device according to claim 7 wherein the teeth of the first comb blade are planar and the width thereof corresponds substantially to the spacing between the cutting knives.

9. A meat cutting device according to claim 1 including a shaft carried by said body part for mounting said knives, said cutting knives of said blade assembly being detachably arranged on said shaft and means for adjustably spacing said knives one from the other.

10. A meat cutting device according to claim 1 including a feeding lid and means mounting said lid on said body part for rotation in said feeding chute above said blade assembly.

11. A meat cutting device according to claim 1 wherein the angle of point of said knives is about 12°.

12. A meat cutting device according to claim 3 wherein said teeth extend between said knives such that all of the meat received from the chute is cut by the knives and passes through the blade assembly between the adjacent knives.

13. A meat cutting device according to claim 1 wherein said inclined path for the meat is defined by the front wall of said feeding chute and disposed to incline downwards towards said blade assembly, a first comb blade carried by said front wall and having teeth extending downwards and partly between said cutting knives, the teeth of said first comb blade being planar and the width thereof corresponding substantially to the spacing between the cutting knives, a second comb blade carried by said rear wall opposite said front wall and having teeth extending upwards and partly between the cutting knives, the teeth of said second comb blade being planar and the width thereof corresponding substantially to the spacing between the cutting knives, a feeding lid and means mounting said lid on said body part for rotation in said feeding chute above said blade assembly, said teeth of said first comb blade extending between said knives such that all of the meat received from the chute is cut by the knives and passes through the blade assembly between the adjacent knives.

* * * * *